US008491018B2

(12) United States Patent
Borrowman et al.

(10) Patent No.: US 8,491,018 B2
(45) Date of Patent: Jul. 23, 2013

(54) SYSTEMS AND METHODS FOR TYING A BOW AROUND AN OBJECT

(75) Inventors: Eric L. Borrowman, St. Peters, MO (US); J. Edgar Biggs, III, Chesterfield, MO (US)

(73) Assignee: Innoventor, Incorporated, St. Louis, MO (US)

( * ) Notice: Subject to any disclaimer, the term of this patent is extended or adjusted under 35 U.S.C. 154(b) by 147 days.

(21) Appl. No.: 13/070,102

(22) Filed: Mar. 23, 2011

(65) Prior Publication Data

US 2011/0233930 A1 Sep. 29, 2011

Related U.S. Application Data

(60) Provisional application No. 61/317,071, filed on Mar. 24, 2010.

(51) Int. Cl.
*B65H 69/04* (2006.01)

(52) U.S. Cl.
USPC ..... 289/2

(58) Field of Classification Search
USPC ..... 289/2, 13, 15, 18.1; 223/46
See application file for complete search history.

(56) References Cited

U.S. PATENT DOCUMENTS

| | | | | |
|---|---|---|---|---|
| 3,147,894 | A | 9/1964 | Zenk | |
| 3,236,426 | A | 2/1966 | Kerrigan et al. | |
| 3,498,509 | A | 3/1970 | Hagenbuch | |
| 4,362,096 | A | 12/1982 | Hanscom | |
| 5,261,578 | A | 11/1993 | Monahan | |
| 6,543,819 | B2 * | 4/2003 | Hakimain | 289/2 |
| 6,981,537 | B2 * | 1/2006 | Cyr et al. | 156/502 |
| 7,404,583 | B1 * | 7/2008 | Hassen | 289/1.5 |
| 7,841,631 | B2 * | 11/2010 | Holmes et al. | 289/2 |
| 2003/0020280 | A1 * | 1/2003 | Hakimain | 289/2 |
| 2009/0282661 | A1 * | 11/2009 | Jensen et al. | 28/147 |
| 2010/0148503 | A1 * | 6/2010 | Holmes et al. | 289/2 |

OTHER PUBLICATIONS

International Search Report and Written Opinion of PCT/US2011/029637; May 31, 2011; 9 pages.

* cited by examiner

*Primary Examiner* — Shaun R Hurley
(74) *Attorney, Agent, or Firm* — Armstrong Teasdale LLP

(57) ABSTRACT

Systems and methods are provided for tying material into a bow around an object. The system includes a tying assembly for tying the material around the object into the bow and a jig assembly moveable relative to the tying assembly for positioning the material relative to the tying assembly. The tying assembly includes a first loop gripper and a second loop gripper configured to grip respective first and second portions of the material. The first loop gripper is configured to pull the first portion of the material through the second portion of the material. The second loop gripper is configured to pull the second portion of the material through the first portion of the material. A first tail gripper and a second tail gripper are provided to grip respective first and second ends of the material. The jig assembly includes a first jig half and a second jig half that are each rotatable about a longitudinal axis of the first jig half and the second jig half. The jig assembly also includes a trolley assembly for moving said first jig half and said second jig half with respect to said tying assembly.

20 Claims, 16 Drawing Sheets

SYSTEMS AND METHODS FOR TYING A BOW AROUND AN OBJECT

CROSS-REFERENCE TO RELATED APPLICATION

This application claims priority to U.S. Provisional Patent Application No. 61/317,071 filed Mar. 24, 2010, the entire disclosure of which is hereby incorporated by reference in its entirety.

FIELD

The field of the disclosure relates generally to systems and methods for tying a knot and, more specifically, to systems and methods for tying a bow around an object.

BACKGROUND

Bows are knots formed from a piece of material such as string, yarn, or ribbon and have two opposed loops and corresponding loose ends. Bows are often tied around a portion of an object to close an opening of the object. For example, a bow can be tied around a portion of a bag to secure items placed in the bag. A bow may also be tied around an object to increase the aesthetic appeal of an object. For example, a bow may be tied around a box or other container. Once tied around an object, bows are easily untied by pulling one or both of the loose ends.

Previous systems for tying bows typically relied on one of two approaches; each of which has their own disadvantages and fails to yield satisfactory results. In the first approach, the bow is manually tied around the object by a user. Manual tying of bows is a time-intensive and costly procedure. As such, this approach is ill-suited for use in a production environment.

In the second approach, a bow-like arrangement is formed by folding a piece of material multiple times over itself such that the material appears to be in a looped configuration. The bow-like arrangement is then glued or otherwise set in the looped configuration and affixed to the object. As the arrangement is not a bow, it cannot be untied by pulling one of the loose ends of the material. Moreover, the bow-like arrangement is merely affixed to the object, and is not tied around the object. Examples of such bow-like arrangements include those often placed on wrapped gifts or presents.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION OF THE INVENTION

In one aspect, a system for tying material into a bow around an object is described. The system includes a tying assembly for tying the material around the object into the bow and a jig assembly moveable relative to the tying assembly for positioning the material relative to the tying assembly. The tying assembly includes a first loop and a second loop gripper configured to grip respective first and second portions of the material. The first loop gripper is configured to pull the first portion of the material through the second portion of the material. The second loop gripper is configured to pull the second portion of the material through the first portion of the material. A first tail gripper and a second tail gripper are provided to grip respective first and second ends of the material. The jig assembly includes a first jig half and a second jig half that are each rotatable about a longitudinal axis of the first jig half and the second jig half. The jig assembly also includes a trolley assembly for moving the first jig half and the second jig half with respect to the tying assembly.

In another aspect, a system for tying material into a bow around an object is described. The system includes a cutting mechanism for cutting material dispensed from a bulk source of the material, a tying assembly for tying the material around the object into the bow, and a jig assembly for positioning the material relative to the tying assembly. The tying assembly comprises a first loop gripper and a second loop gripper. The first loop gripper is configured to grip a first portion of the material and the second loop gripper is configured to grip a second portion of the material. The first loop gripper is configured to pull the first portion of the material through the second portion of the material. The second loop gripper is configured to pull the second portion of the material through the first portion of the material. A first tail gripper and a second tail gripper are provide to grip respective first and second ends of the material. The jig assembly is moveable relative to the tying assembly and includes a first jig half and a second jig half that are each rotatable about a longitudinal axis of the first jig half and the second jig half. The jig assembly also includes a trolley assembly for moving the first jig half and the second jig half with respect to the tying assembly.

In another aspect, a method of tying material around an object into a bow using a tying assembly comprising a first loop gripper, a second loop gripper is described. The method comprises gripping a first portion of the material with the first loop gripper, gripping a second portion of the material with the second loop gripper, pulling, with the first loop gripper, the first portion of the material through the second portion of the material, and pulling, with the second loop gripper, the second portion of the material through first portion of the material to tie the material around the object into a bow.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols in the various drawings indicate like elements.

DETAILED DESCRIPTION OF THE INVENTION

As further disclosed by the described embodiments, a system and a method are described for the tying of a bow with material around an object. The system and method provide for the automated tying of a bow with material having two loose ends around an object. Once tied around the object, the bow may be untied by pulling on either one of the loose ends of the bow. The bow may be formed from any suitable material, such as ribbon, rope, yarn, string, cable, or wire. Embodiments of the system include a carousel having a plurality of rolls of different types of material for forming the bow, a dispensing mechanism for dispensing material from the rolls, and a cutting mechanism for cutting the dispensed material. Embodiments of the system also include a forming mechanism for tying the bow around the object. While the embodiments disclosed herein reference tying a bow around an object, other uses are contemplated as well. For example, the systems may be used to tie a bow that is later affixed to an object by adhesive or another suitable mechanism.

Figure 1:
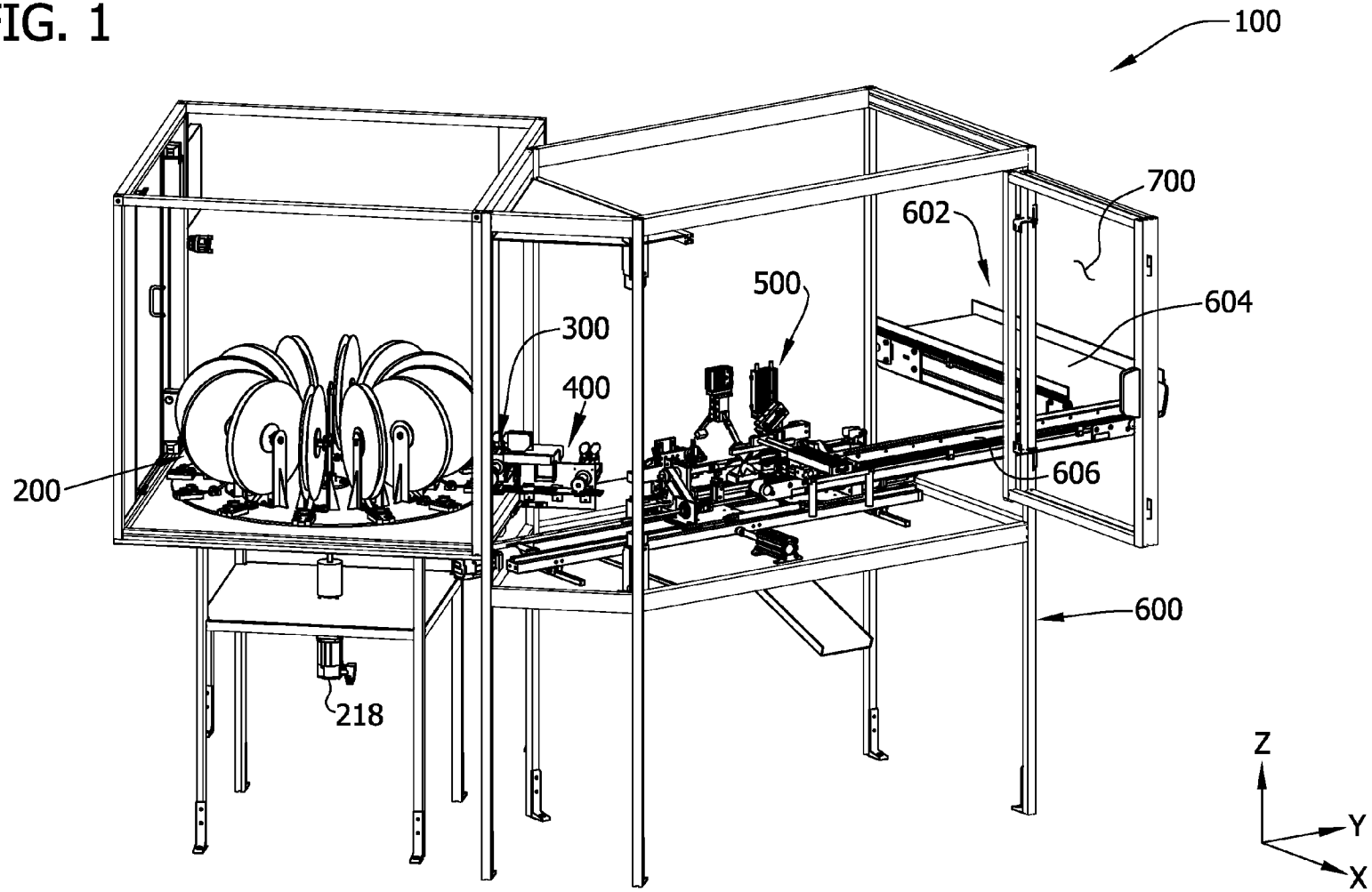
FIG. 1 is a perspective view of a system for tying a bow.

Referring more particularly to the drawings, embodiments of the disclosure may be described in the context of a system 100 as shown in FIG. 1. The system 100 includes a carousel 200, a dispensing mechanism 300, a cutting mechanism 400, and a forming mechanism 500. A control system (not shown) comprising one or more computer processors, input/output devices, and computer readable forms of memory storing computer executable instructions thereon are provided for controlling the operation of the system 100. Moreover, in the exemplary embodiment, the system 100 also includes a frame 600 for supporting the components of the system. A plurality of transparent panels 700 are coupled to the frame 600 to prevent unauthorized access to the components of the system 100. The transparent panels 700 may be formed from any suitable material, such as wire mesh, expanded metal, or an acrylic, glass-like material. The frame 600 and transparent panels 700 are omitted from FIGS. 2-15 for the sake of clarity.

Figure 2:
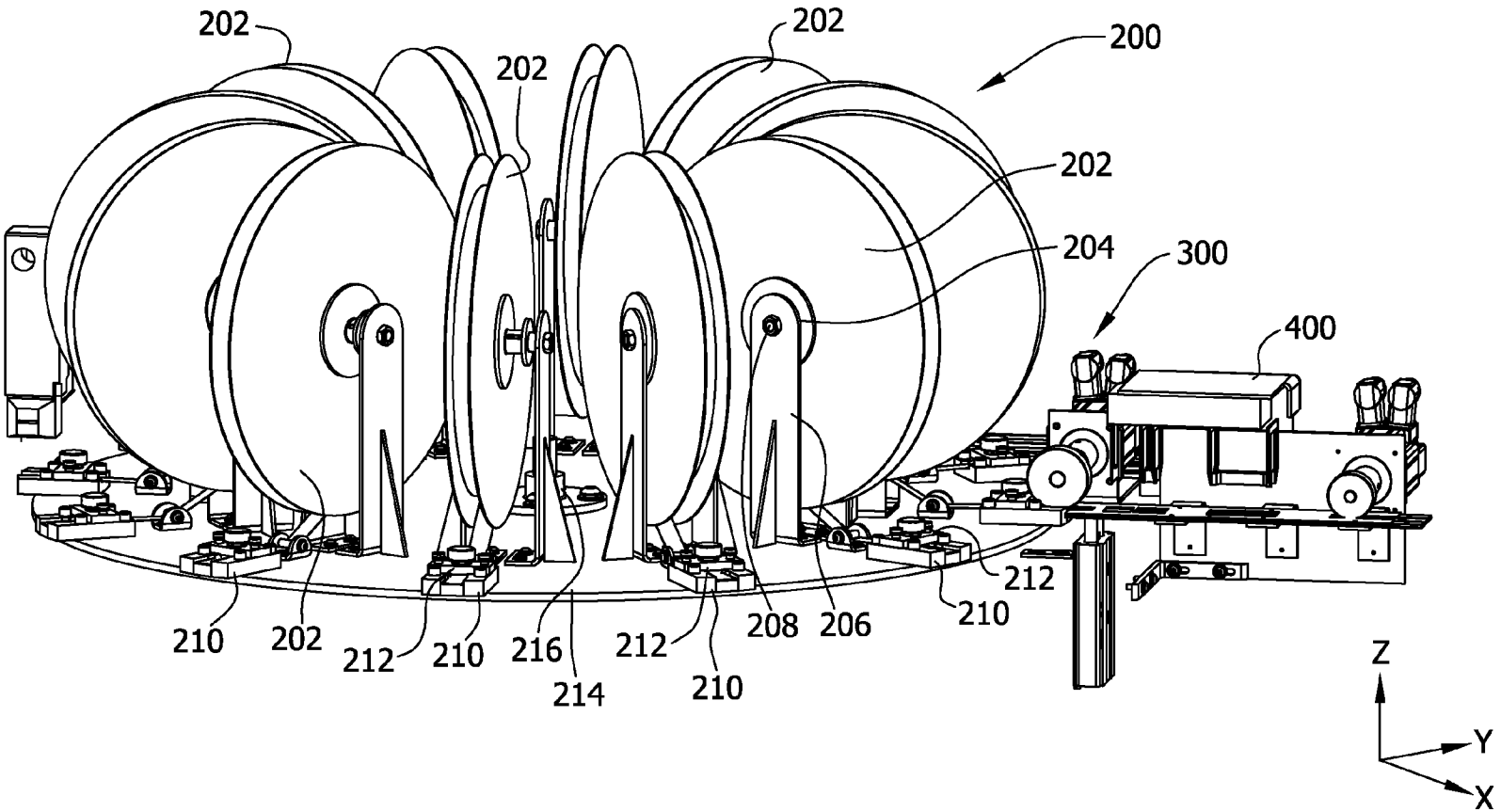
FIG. 2 is a perspective view of a ribbon carousel and a cutting mechanism associated with the system shown in FIG. 1.

Turning now to FIG. 2, the carousel 200 (broadly, a bulk source) includes a plurality of rolls 202 of material used by the forming mechanism 500 to form bows tied around an object. The rolls 200 are each coupled to a corresponding hub 204 and support structure 206 such that the rolls are free to rotate about the hub. A suitable closure mechanism 208 is provided to couple the rolls 202 to the hubs 204. The closure mechanism 208 in the exemplary embodiment includes a nut and a bolt which passes through the hub 204. A tension mechanism 210 is disposed adjacent each of the rolls 202 and functions to impart tension on the material as it is paid off of the roll. The tension mechanism 210 may impart tension on the material by contacting the material and exerting force thereon with a friction element 212. The support structures 206 for each of the rolls 200 and the tension mechanisms 210 are coupled to a turntable 214. The turntable 214 is rotatable about a central hub 216 such that the carousel 200 can be rotated to position each roll 202 adjacent the dispensing mechanism 300. A drive source 218 (FIG. 1) is coupled to the central hub 216 to rotate the turntable 214.

In the exemplary embodiment, each roll 202 contains a different type of ribbon. For example, each of the rolls 202 may contain a different color or size of ribbon. In other embodiments, the rolls 202 contain different types of material, such as ribbon, rope, yarn, string, cable, or wire. Accordingly, while reference will be made herein to the use of ribbon to tie bows around the object with the system 100, different types of materials may be contained on the rolls 202 and used in the system without departing from the scope of the embodiments. Moreover, a level indicator (not shown) may be provided for each roll 202 to monitor the amount of material present in each roll.

Figure 3:
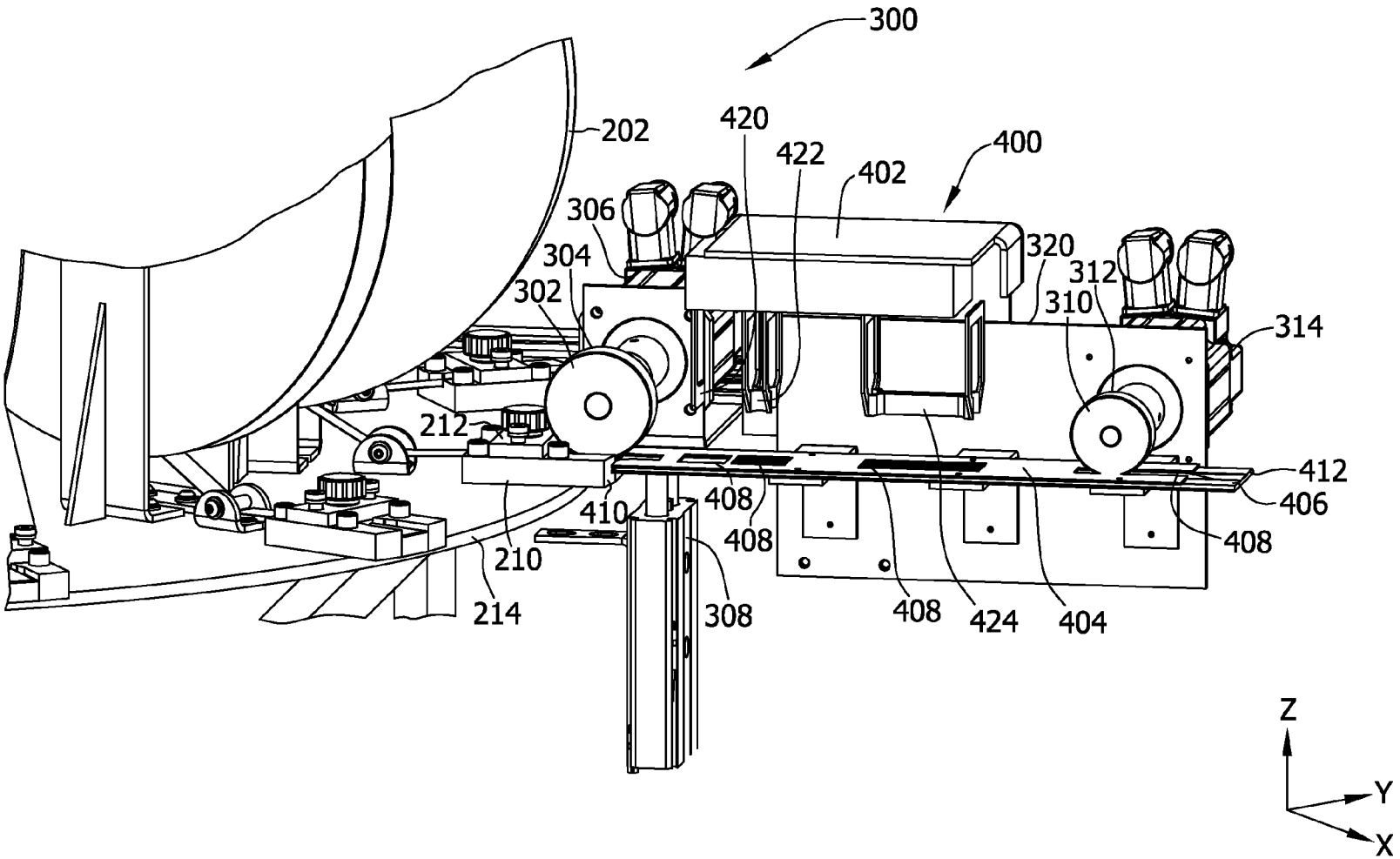
FIG. 3 is a perspective view of the cutting mechanism of FIG. 2.

With reference now to FIG. 3, the dispensing mechanism 300 and cutting mechanism 400 are more clearly shown. The dispensing mechanism 300 includes a first contact wheel 302 for contacting the ribbon as it is paid off of the roll 202. The first contact wheel 302 is positioned adjacent the tension mechanism 210 of each roll 200 and to the left of the cutting mechanism 400 in the depiction of FIG. 3. The first contact wheel 302 has an outer surface 304 formed from a material having a relatively high co-efficient of friction. The first contact wheel 302 is coupled to a first drive motor 306 that is operable to rotate the first contact wheel. The first drive motor 306 is coupled to a support stand 308 that is operable to move vertically in the direction of the z-axis to raise and lower the first drive motor and first contact wheel 302. The support stand 308 is positioned in a raised orientation during rotation of the carousel 200 and is positioned in lowered orientation to pay off the ribbon from the roll 202 (FIG. 3).

A second contact wheel 310 is provided to aid in the paying off of ribbon from the roll 202. The second contact wheel 310 is positioned adjacent the cutting mechanism 400 and to the right of the cutting mechanism 400 in the depiction of FIG. 3. The second contact wheel 310 has an outer surface 312 from a material having a relatively high co-efficient of friction. A second drive motor 314 is coupled to the second contact wheel 310 and is operable to rotate the second contact wheel. The second drive motor 314 is in turn coupled to a dispensing frame 320.

The cutting mechanism 400, as best seen in FIG. 3, is positioned between the first contact wheel 302 and second contact wheel 310 of the dispensing mechanism 300. The cutting mechanism 400 includes an upper plate 404 and a lower plate 406 that each run the length of the cutting mechanism 400. The upper plate 404 and lower plate 406 are spaced apart such that the ribbon is able to fit between the upper and lower plate. A first end 410 of the lower plate 406 is positioned generally adjacent the tension mechanism 210 of the carousel 200. A second end 412 of the lower plate 406 is disposed to the right of the first end 410 in the depiction of FIG. 3. The upper plate 404 includes a plurality of openings 408 formed therein. The openings 408 disposed adjacent the first end 410 and second end 412 of the lower plate 406 permit the respective outer surfaces 304, 312 of the contact wheels 302, 310 to contact the ribbon.

Figure 16:
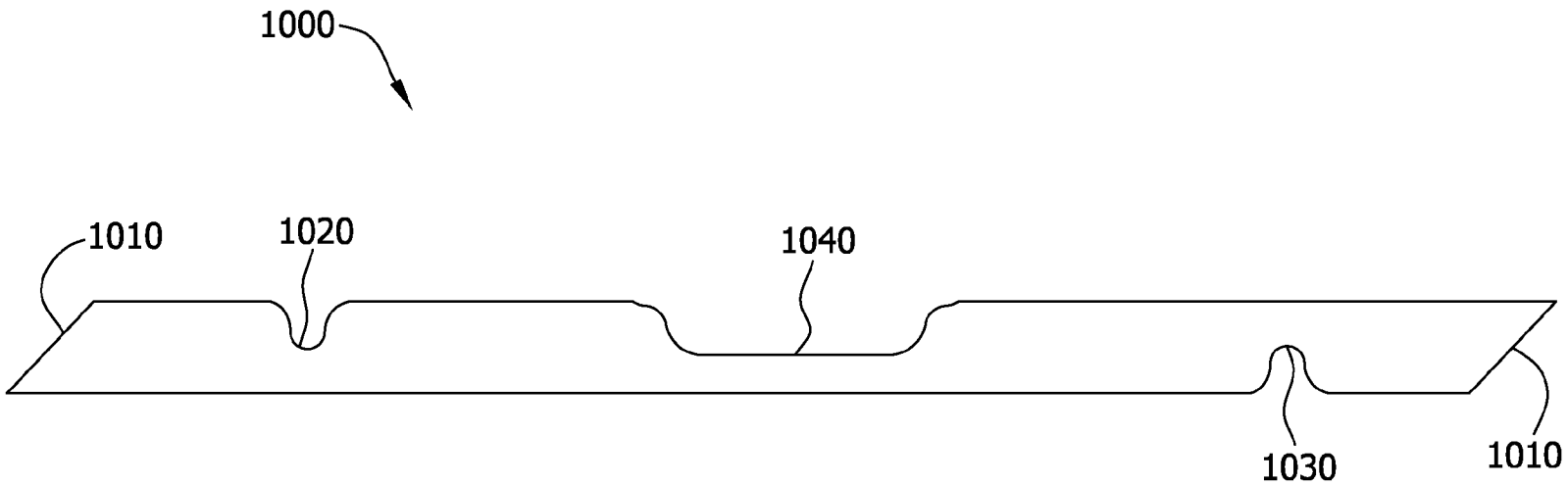
FIG. 16 is a top plan view of an exemplary cut ribbon.

The cutting mechanism also includes a cutting head 402 that is vertically moveable in the direction of the z-axis. A first cutting element 420, a second cutting element 422, and a third cutting element 424 are mounted to the cutting head 402 and depend downward therefrom. The cutting elements 420, 422, and 424 are mounted on the cutting head 402 such that they are disposed above corresponding openings 408 in the upper plate 404. Each of the cutting elements 420, 422, 424 have a sharp edge disposed away from the cutting head 402 that is configured to cut the ribbon upon contact therewith. An exemplary piece of cut ribbon is shown in FIG. 16 and indicated generally at 1000.

The first cutting element 420 is configured to cut the ribbon along the entirety of its width, such that the ribbon is cut into discrete lengths that are of the proper size to be tied around an object by the forming mechanism 500. As shown in FIG. 16, the first cutting element 420 cuts ends 1010 of the ribbon 1000 at an angle in the example embodiment, although other embodiments may cut the ends perpendicular to the ribbon (i.e., "squared-off") or any other desired angle.

The second cutting element 422 is configured to cut a pair of notches 1020, 1030 into the ribbon 1000. The notches 1020, 1030 are disposed on opposing sides of the ribbon 1000 and spaced longitudinally from each other in the example embodiment. In other embodiments, the notches 1020, 1030 are disposed directly across from each other on the ribbon. Moreover, additional similar notches may be cut in the ribbon 1000 without departing from the scope of the embodiments.

The third cutting element 424 is configured to cut an elongated notch 1040 in the ribbon 1000. The elongated notch 1040 may be cut into the opposite side of the ribbon 1000 from that shown in FIG. 16 without departing from the scope of the embodiments. The elongated notch 1040 is disposed generally about the mid-point of the ribbon 1000 in the example embodiment, although in other embodiments the notch 1040 may be offset from the mid-point in either direction. Moreover, the third cutting element 424 may be configured to cut a pair of such elongated notches 1040 into the ribbon in other embodiments.

In other embodiments the second cutting element 422 and third cutting element 424 may be sized differently without departing from the scope of the disclosure. Moreover, the second cutting element 422 and/or the third cutting element 424 may not be used, or additional cutting elements may be used, without departing from the scope of the disclosure.

The notches cut into the ribbon by the second cutting element 422 and third cutting element 424 aid in the tying of the ribbon into a bow by the forming mechanism 500. For example, the notches cut in the ribbon may resemble the cut outs formed in traditional bow ties worn around the neck of a person. All of or portions of the cutting mechanism 400 may be ultrasonically vibrated during cutting of the ribbon 1000. This ultrasonic vibration of components of the cutting mechanism aids in cutting the ribbon 1000.

The forming mechanism 500, as best seen in FIGS. 4-7 is positioned adjacent to the cutting mechanism 400. The forming mechanism 500 broadly includes a jig assembly 502 and a tying assembly 503. The jig assembly 502 is generally provided for transporting ribbon from the dispensing mechanism 300 and cutting mechanism 400 to the tying assembly 503. The jig assembly 502 also positions the ribbon such that the tying assembly 503 is able to tie bows formed from the ribbon. The tying assembly 503 is generally directed to tying a bow around an object 505. In the exemplary embodiment, the object 505 is a bag while in other embodiments the object can be any other article.

Figure 7:
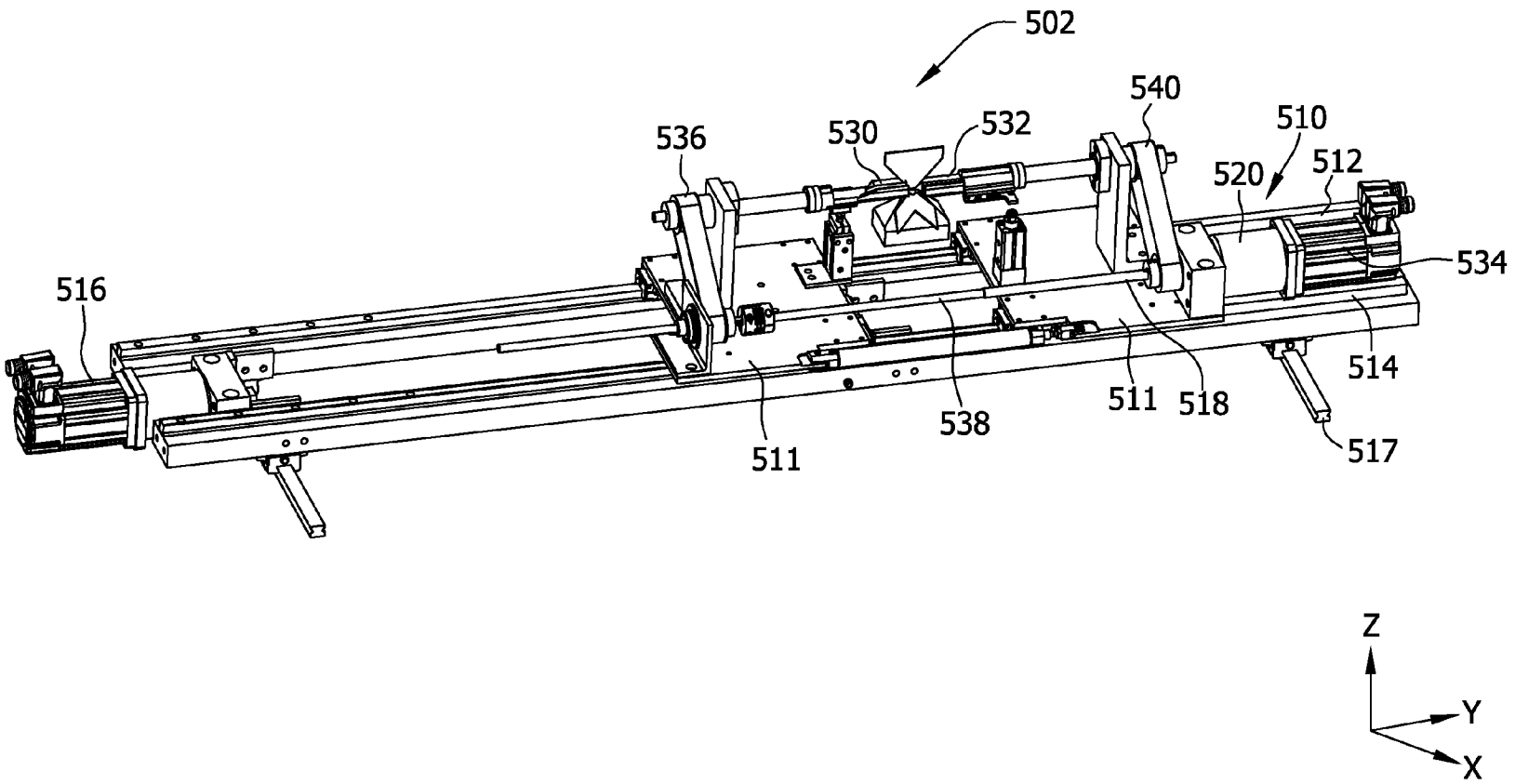
FIG. 7 is a perspective view of a jig assembly shown in FIG. 4.

The jig assembly 502, as best seen in FIG. 7, includes a trolley assembly 510 having a platform 511 traveling on a first rail 512 and a second rail 514. The platform 511 is moved along the first rail 512 and the second rail 514 in a direction generally parallel to y-axis by a trolley drive 516 coupled to a ball screw 518. The ball screw 518 is in registry with a nut 520 coupled to the platform 511. Accordingly, rotation of the ball screw 518 by the trolley drive 516 results in linear movement of the platform 511 along the first rail 512 and the second rail 514. The trolley drive 516 is any suitable drive, such as a servo motor, a stepping motor, or an actuator. The platform 511 travels on a third rail 515 and a fourth rail 517 in a direction generally parallel to the x-axis. The platform 511 is moved along the third rail 515 and the fourth rail 517 by a suitable drive (not shown), such as a servo motor, a stepping motor, or an actuator. Accordingly, the platform 511 is moveable along axes parallel to the x-axis and y-axis. While the platform 511 and rails 512, 514, 515, 517 are used in the exemplary embodiment to move the jig assembly 502, any other suitable mechanism may be used to move the jig assembly without departing from the scope of the embodiments.

The jig assembly 502 includes a first jig half 530 and a second jig half 532 for positioning the ribbon. A jig drive 534 is coupled to the first jig half 530 such that rotation of the jig drive results in rotation of the first jig half. The jig drive 534 is any suitable drive, such as a servo motor, a stepping motor, or an actuator. The jig drive 534 is coupled by a first jig drive belt 536 to a jig drive shaft 538. The jig drive shaft 538 is in turn coupled to a second jig drive belt 540 that is coupled to the second jig half 532. Accordingly, rotation of the jig drive 534 results in corresponding rotation of both the first jig half 530 and the second jig half 532. In other embodiments, the second jig half 532 may instead be rotated by a separate drive.

Figure 8:
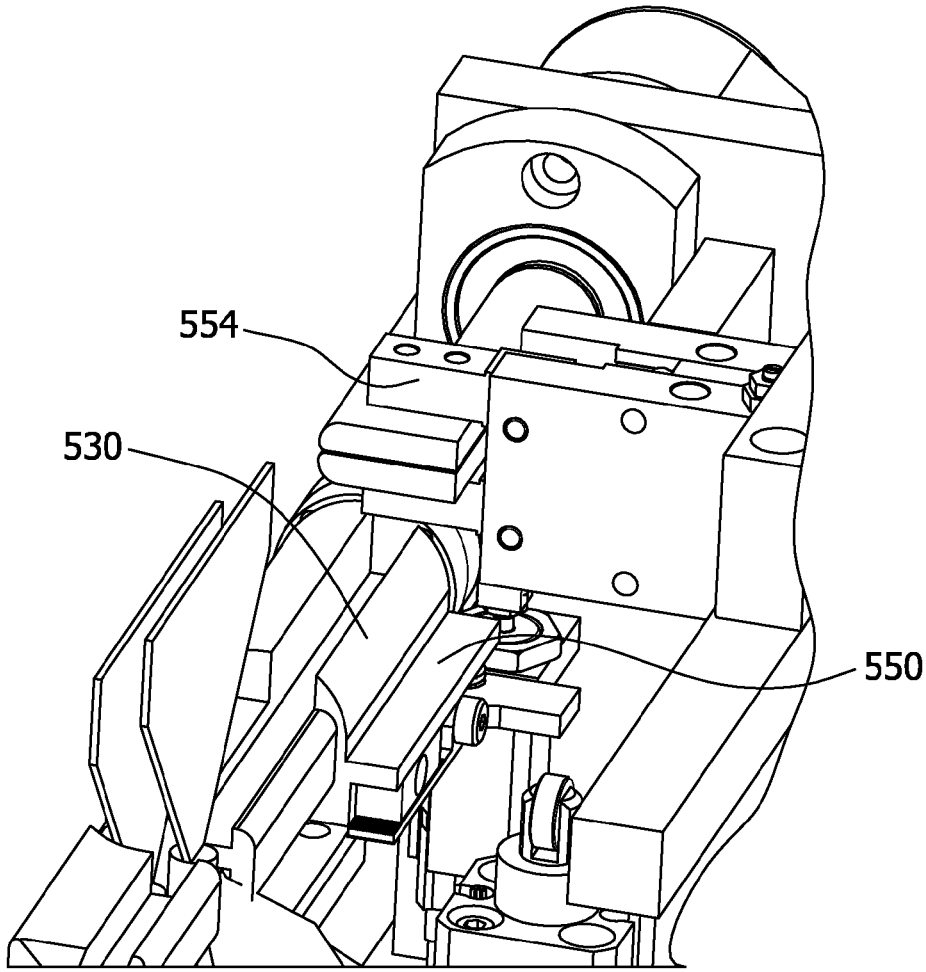
FIG. 8 is a perspective view of a tail gripper in a closed position.
Figure 8:
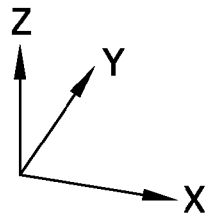
Figure 9:
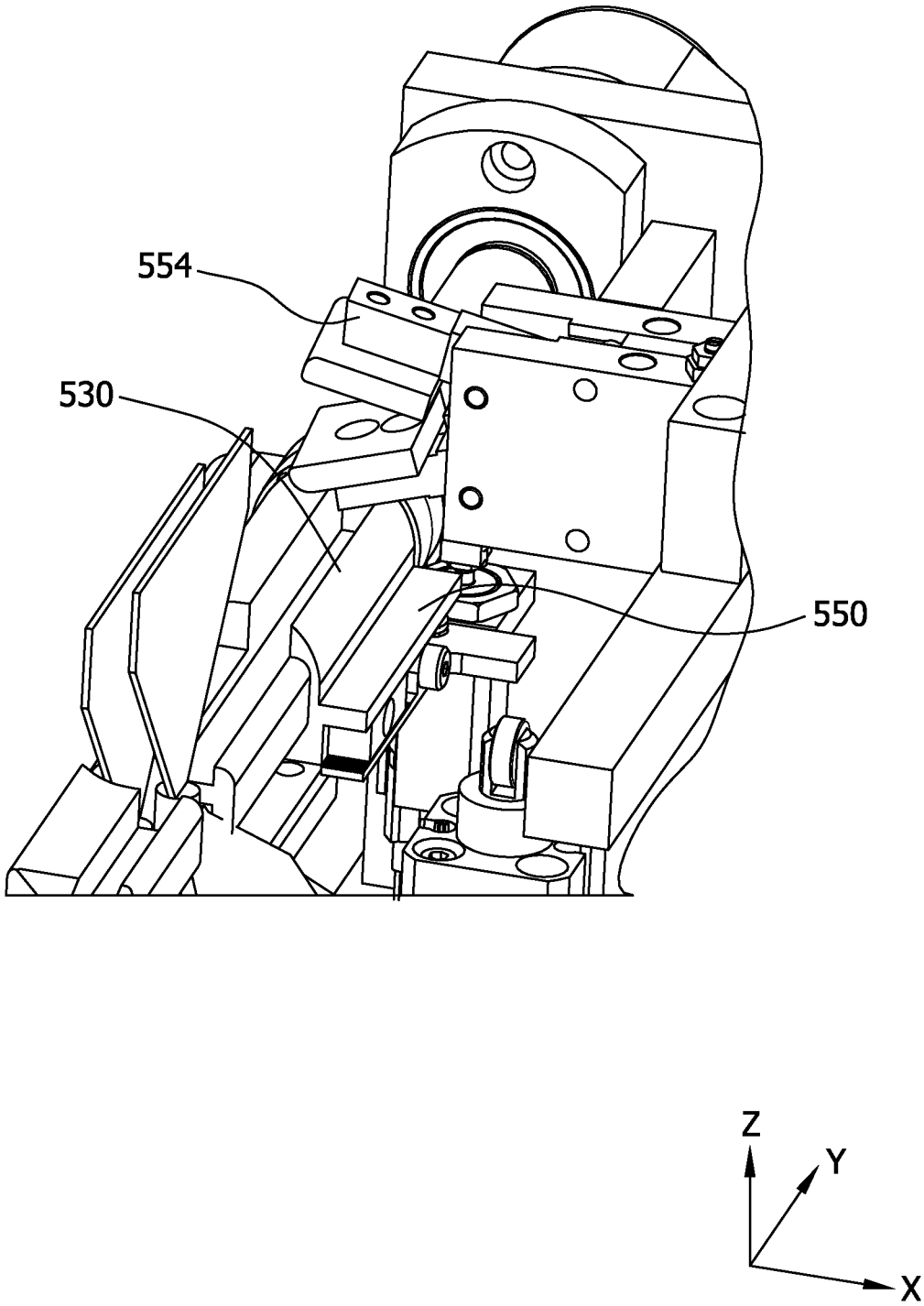
FIG. 9 is a perspective view of the tail gripper of FIG. 8 in an open position.

As shown in FIGS. 8 and 9, a first jig gripper 550 is disposed adjacent and attached to the first jig half 530 and a second jig gripper (not shown) is disposed adjacent and attached to the second jig half 532. The jig grippers 550 have opposing portions that are operable to grip a piece of ribbon therein. The opposing portions of the jig grippers 550 are movable by an actuator or air cylinder (not shown) between an open position where a gap is present between the portions and a closed position (as shown in FIGS. 8 and 9) where the gap is not present. The opposing portions of the jig grippers 550 are moved by the actuator or air cylinder to the open position and a portion of a ribbon is then inserted between the portions. The opposing portions are then moved to the closed position to secure the ribbon between the portions. The jig grippers 550 may be biased in the closed position by a spring or other resilient member.

A first tail gripper and a second tail gripper, as shown in the example gripper 554 of FIGS. 8 and 9, are disposed adjacent the first jig half 530 and the second jig half 532, respectively. The tail grippers are coupled to a support structure (not shown). The tail grippers are configured to grip respective ends, or tails, of the piece of ribbon with opposing portions. The grippers are moveable between an open position (FIG. 9) where the opposing portions are spaced apart and a closed position (FIG. 8) where the opposing portions are not spaced apart. The opposing portions of the tail grippers are moved between the open position and the closed position by respective actuators (not shown).

Figure 10:
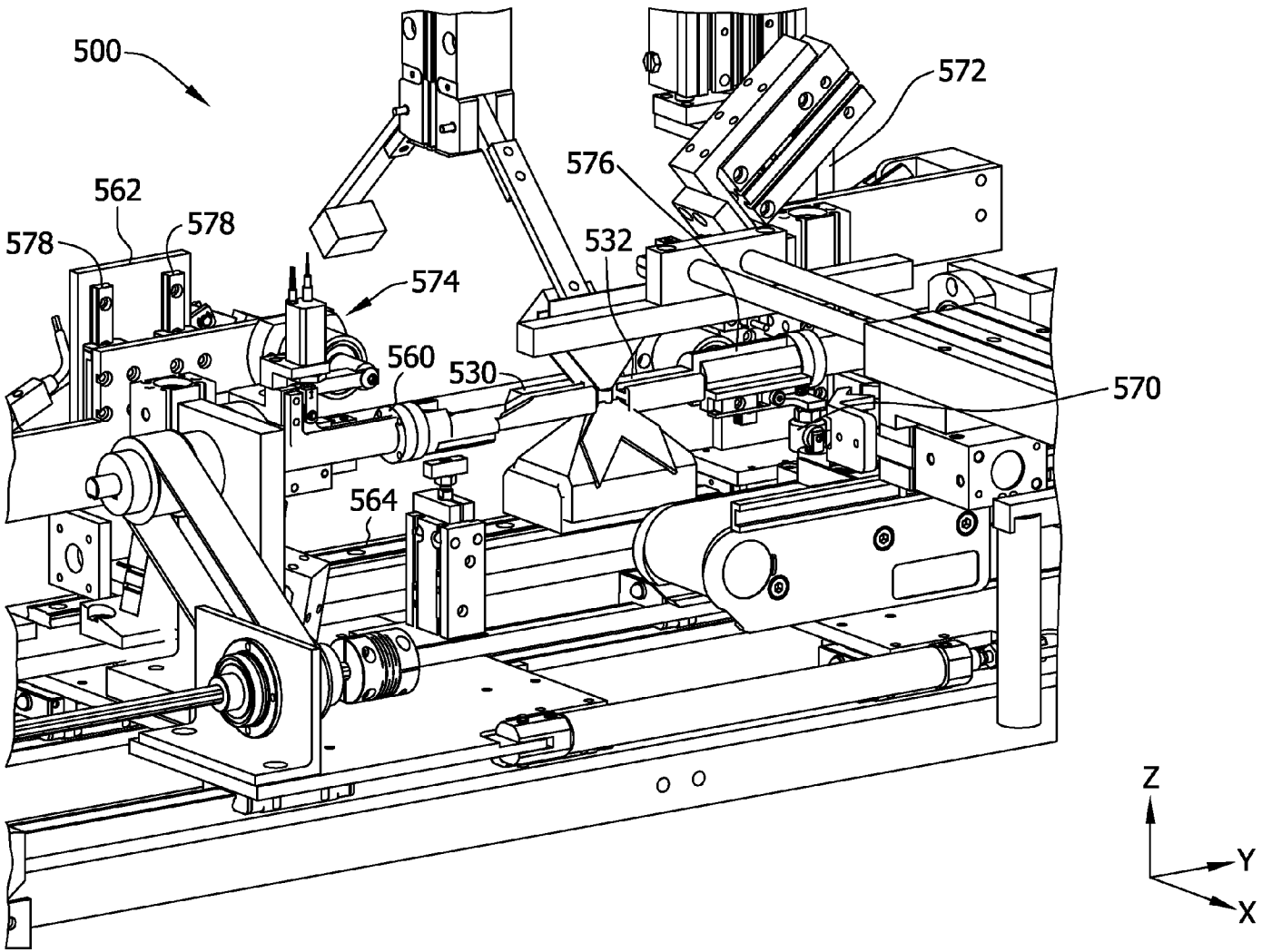
FIG. 10 is an enlarged view of the forming mechanism of FIG. 4.

As best seen in FIG. 10, a first loop gripper 560 and a second loop gripper 570 are provided to grip portions of the ribbon and pull it through opposing loops of the ribbon to tie the bow. The first loop gripper 560 is coupled to a first frame 562 and the second loop gripper 570 is coupled to a second frame 572. The first frame 562 and second frame 572 are in turn each coupled to a frame rail 564 such that they are independently movable along the frame rail in a direction generally parallel to the y-axis. The first loop gripper 560 and second loop gripper 570 are moved along the frame rail 564 by a suitable actuator or motor. The first frame 562 and second frame 572 also each include respective first vertical rails 578 and second vertical rails 580 (FIG. 6) that permit the loop grippers 560, 570 to move in a vertical direction generally parallel to the z-axis. A suitable actuator or motor is used to move the frames 562, 572 along the vertical rails 578, 580.

The loop grippers 560, 570 each resemble a pair of forceps or needle-nose pliers and have opposing portions that are moveable between an open position where the opposing portions are spaced and a closed position where the opposing portions are not spaced apart. The loop grippers 560, 570 are moveable between the open position and the closed position by respective actuators. In the closed position, the opposing portions of the loop grippers 560, 570 are operable to grip and/or grasp a portion of the ribbon.

The loop grippers 560, 570 are also rotatable with respect to the frames 562, 572 by a respective first actuating assembly 574 and a second actuating assembly 576. The actuating assemblies 574, 576 use any suitable actuator (e.g., a servo motor) to rotate the respective loop grippers 560, 570 about an axis generally parallel to the x-axis.

The object 505 is delivered to the forming mechanism 500 by a conveyor assembly 602, as best seen in FIG. 1. The conveyor assembly 602 has a first conveyor 604 that transports the object 505 in a direction generally parallel to the x-axis. Once the object 505 reaches the end of the first conveyor 604, the object is transferred to a second conveyor 606 that transports the object in a direction generally parallel to the y-axis and towards the forming mechanism 500. The first conveyor 604 may be positioned vertically above the second conveyor 606 such that the object 505 falls from the end of the first conveyor to the second conveyor. The conveyors 604, 606 are each driven by suitable drives. While two conveyors 604, 606 are used in the exemplary embodiment to transport the object 505 to the forming mechanism 500, any other transportation system may be used to transport the object 505 to the forming mechanism 500 without departing from the scope of the embodiments.

Figure 4:
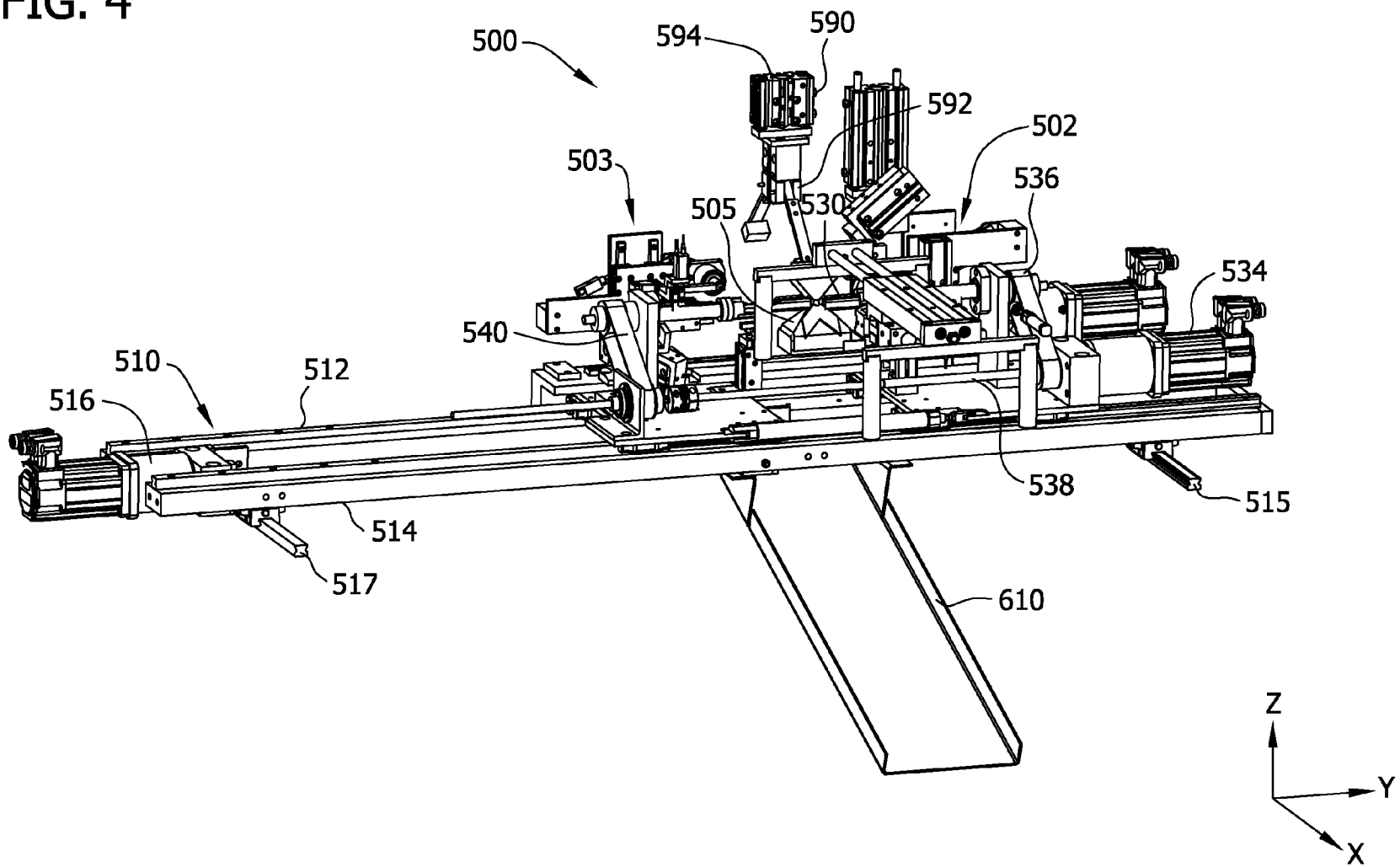
FIG. 4 is a perspective view of a forming mechanism associated with the system shown in FIG. 1.
Figure 5:
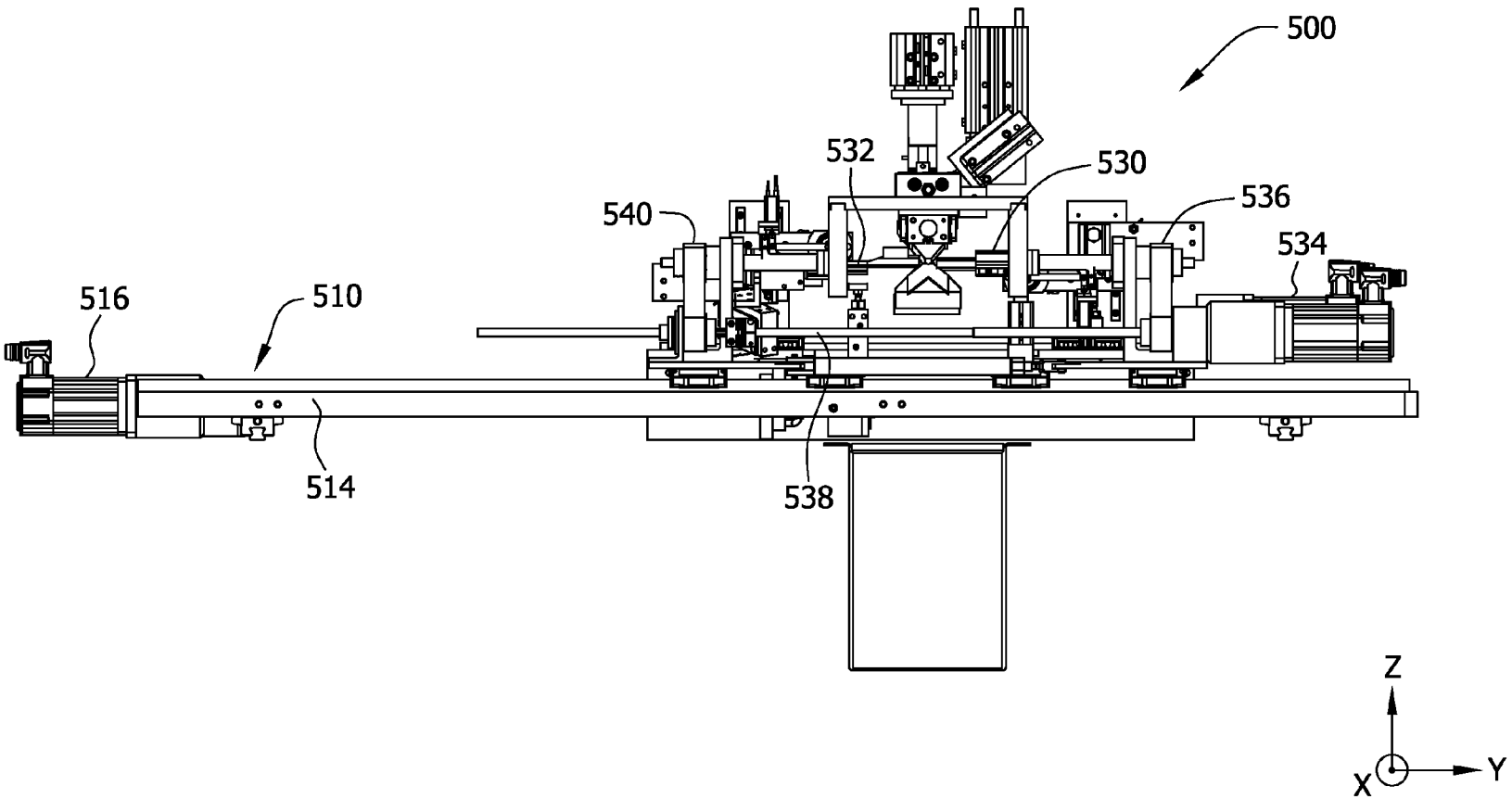
FIG. 5 is a front view of the forming mechanism shown in FIG. 4.
Figure 6:
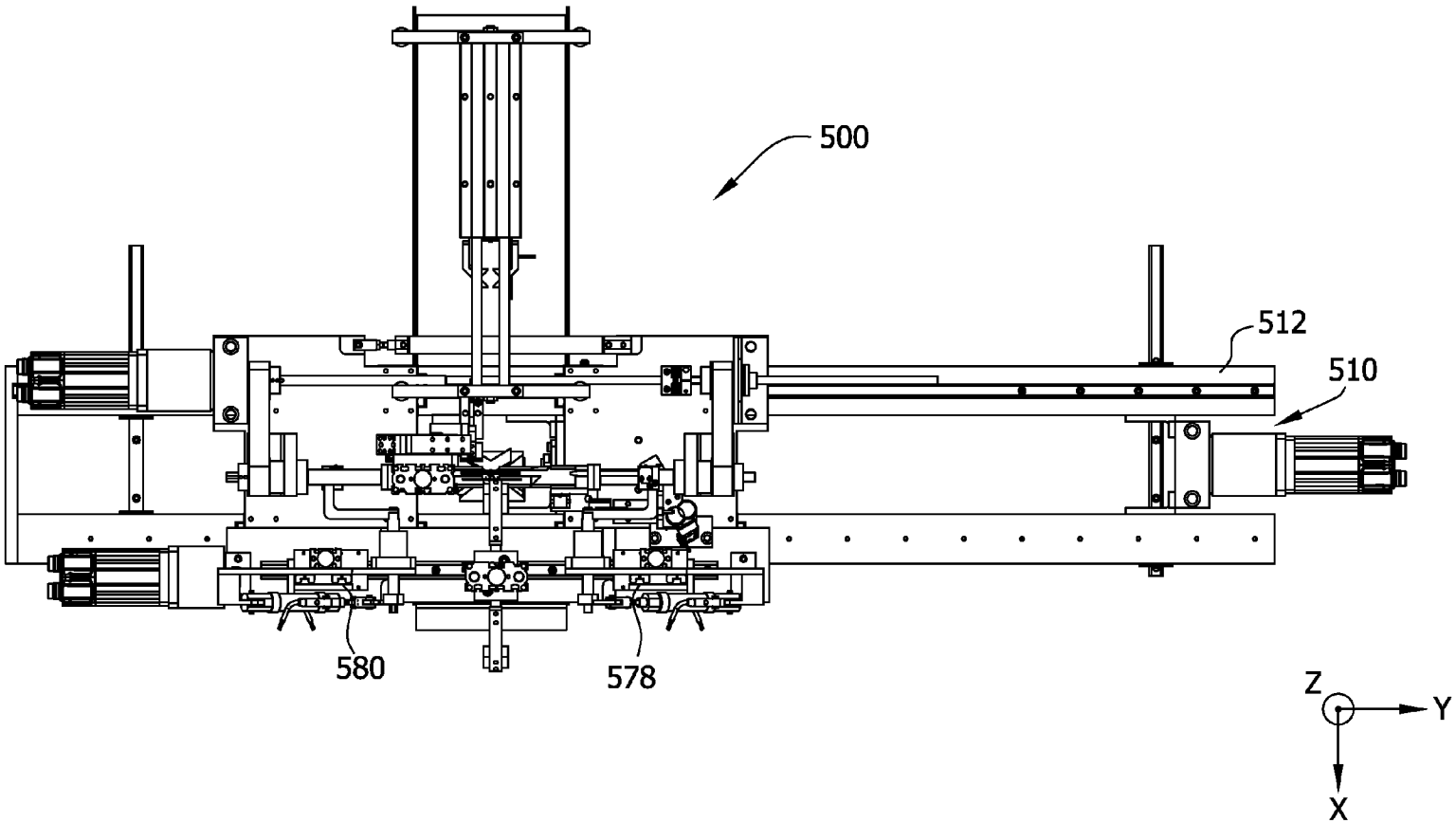
FIG. 6 is a top view of the forming mechanism shown in FIG. 4.

The object 505 is positioned with respect to the forming mechanism by an object positioner 590, as best seen in FIG. 4, which is coupled to the frame 600. The object positioner 590 has a moveable jaw assembly 592 to selectively grasp the object 505. The jaw assembly 592 is moved between an open and a closed position by a jaw actuator 594. The object positioner 590 is also moveable with the aid of actuators in directions generally parallel to the x-axis and y-axis. In the exemplary embodiment, the object positioner 590 is configured to pick the object 505 off of the second conveyor 606 with the jaw assembly 592 and hold the object in position while the forming mechanism 500 ties a bow around the object.

A discharge chute 610 is positioned vertically below the tying assembly 503, as best seen in FIG. 4. The discharge chute 610 is a generally C-shaped structure that is coupled to an underside of the forming mechanism 500 at an angle relative to the z-axis. The discharge chute 610 is angled with respect to the z-axis such that when the object 505 is dropped by the object positioner 590 into the chute it slides down the chute into a receptacle (not shown). In other embodiments, a conveyor or other material transport mechanism may be positioned beneath the forming mechanism 500 such that the object 505 may be placed thereon by the object positioner 590.

FIGS. 11-15 depict an alternative embodiment of the system 100 for tying a bow around an upper portion 950 of the object 505. Each of FIGS. 11-15 depict the system 100 in a different position during the tying of the bow around the object 505. The object 505 is omitted from FIGS. 11-14 for the sake of clarity and is shown in phantom in FIG. 15. The components of the alternative embodiment shown in FIG. 11-15 are the same as or equivalent in function to those shown in FIGS. 1-10 above, except that the actuators and other drives used to manipulate the components of the system 100 are not shown. Accordingly, like terms are used in the description of FIGS. 11-15 to refer to like elements in FIGS. 1-10.

Figure 11:
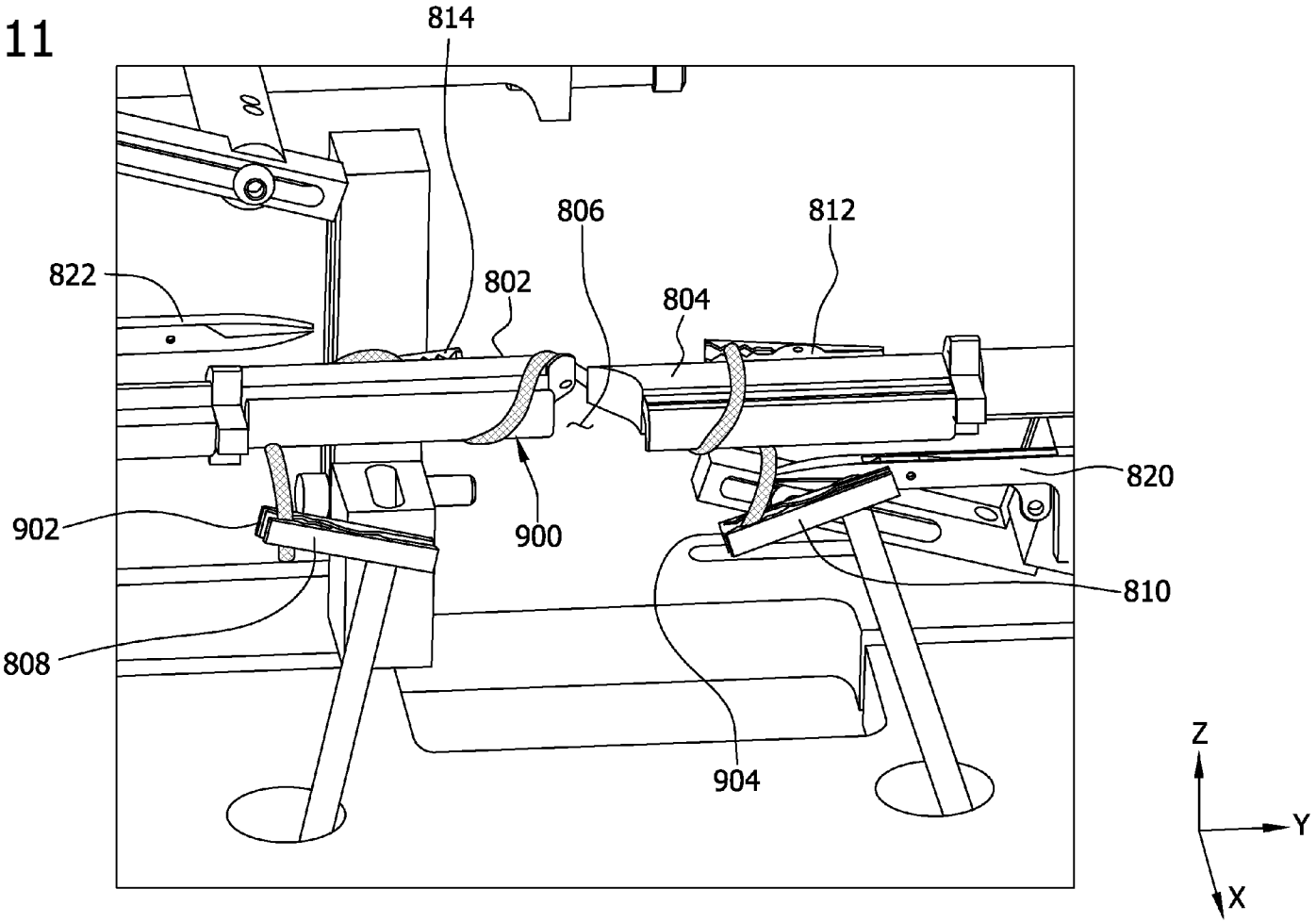
FIG. 11 is a perspective view of an alternative embodiment of a system for tying a bow in a first position.

FIG. 11 shows the system 100 in a first position. The system 100 shown in FIG. 11 includes a first jig half 802 and a second jig half 804 that are spaced apart to define a central opening 806 therebetween. The central opening 806 is sized such that a portion of the object 505 (not shown) is able to be positioned between the jig half 802, 804. The system 100 also includes a first jig gripper 814, a second jig gripper 812, a first loop gripper 822, and a second loop gripper 820 that are each equivalent or the same as the like-named components described above in FIGS. 1-10.

Prior to the system 100 being placed in the first position, a ribbon 900 is first paid off from the roll 202 in the carousel 200 (FIG. 2) by rotation of the first contact wheel 302 and second contact wheel 310 of the dispensing mechanism 300 (FIG. 3). Rotation of the second contact wheel 310 also aids in pulling the ribbon through the cutting mechanism 400.

After the ribbon 900 is paid off from the roll 202, it is cut by the cutting mechanism 400 (FIG. 3). To cut the ribbon 900, the cutting head 402 descends downward in the z-direction such that the cutting elements 420, 422, 424 pass through respective openings 408 in the upper plate 404 and contact the ribbon 900 disposed between the upper plate and the lower plate 406. The cutting head 402 exerts sufficient force on the cutting elements 420, 422, 424 such that they press the ribbon 900 between the cutting elements and the lower plate 406 with sufficient force to cut the ribbon where the edges of the respective cutting elements contact the ribbon.

After being cut by the cutting mechanism 400, the ribbon 900 is wrapped around the jig halves 802, 804. To wrap the ribbon 900 around the jig halves 802, 804, the jig halves are moved laterally to a position adjacent the cutting mechanism 400 by the trolley assembly 510 (FIG. 4). The jig grippers 812, 814 then move to the open position and each jig gripper grips a portion of the ribbon 900 as the jig grippers move to the closed position. The jig halves 802, 804 are then moved laterally by the trolley assembly 510 back to a position adjacent the forming mechanism 500. The jig halves 802, 804 are then rotated by the jig drive 534 such that the ribbon 900 is rotated around the jig halves as shown in FIG. 11. In some embodiments, the jig halves 802, 804 rotate while the trolley assembly 510 is moving, while in other embodiments the jig halves rotate before or after the trolley assembly moves them back to a position adjacent the forming mechanism 500. After moving back to the position adjacent the forming mechanism 500, the first tail gripper 808 grips a first end 902 of the ribbon 900 and the second tail gripper 810 grips a second end 904 of the ribbon.

Figure 12:
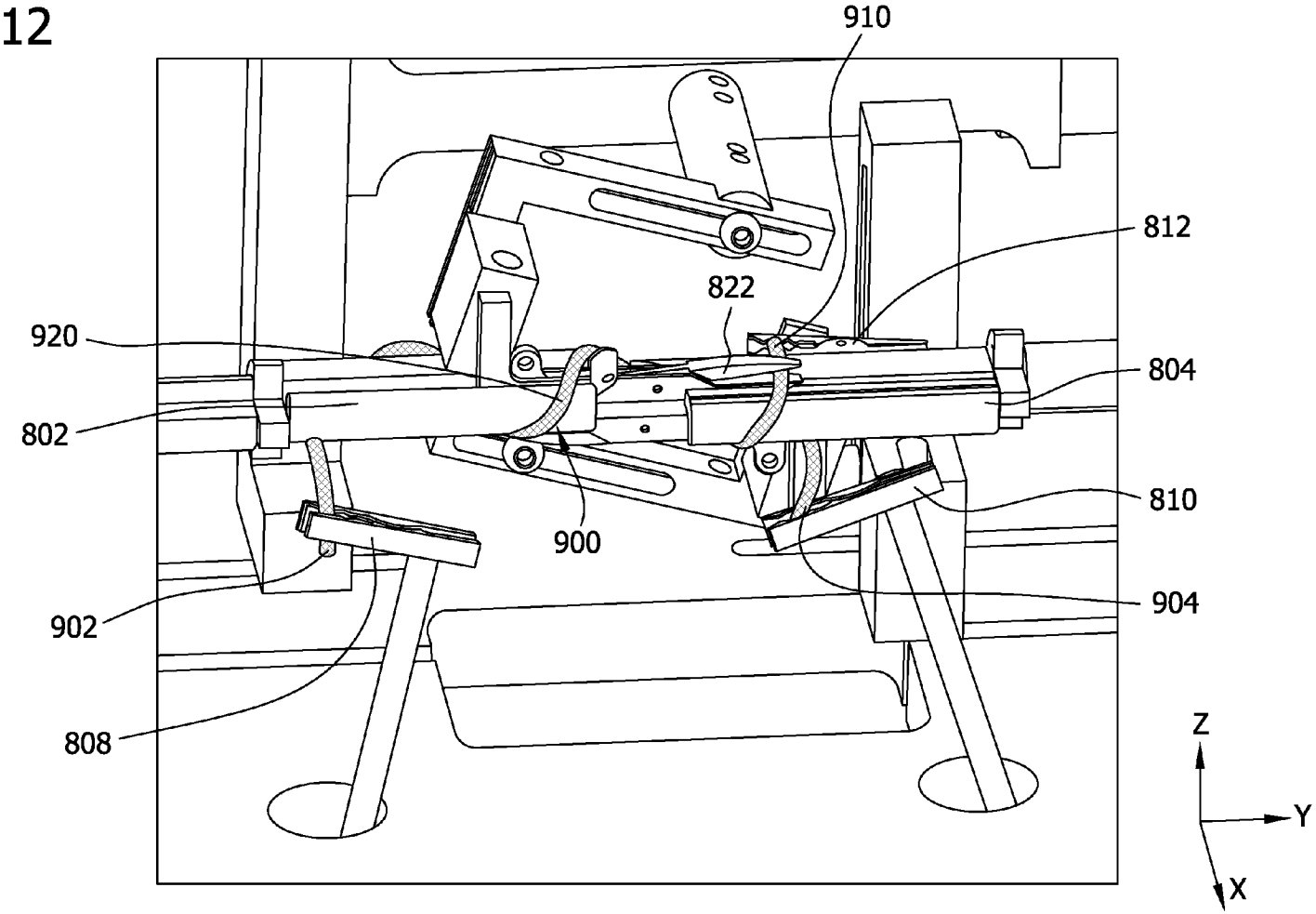
FIG. 12 is a perspective view of the system of FIG. 11 in a second position.

FIG. 12 shows the system 100 in a second position. In the second position, the first loop gripper 822 has moved downward in the z-direction and laterally in the y-direction and its jaws have opened such that the first loop gripper has gripped a portion 910 of the ribbon 900 that will be formed into a first loop. As shown in FIG. 12, the first loop gripper 822 passes adjacent a notch formed along the longitudinal axis of the first jig half 802 and through a portion 920 of the ribbon 900 that is to be formed into a second loop.

The second loop gripper 820 has also moved downward in the z-direction and laterally in the y-direction in FIG. 12 and its jaws have opened such that the second loop gripper has gripped the second loop 920 of the ribbon 900. The second loop gripper 820 passes adjacent a notch formed along the longitudinal axis of the second jig half 804 and through the first loop 910 of the ribbon 900.

Figure 13:
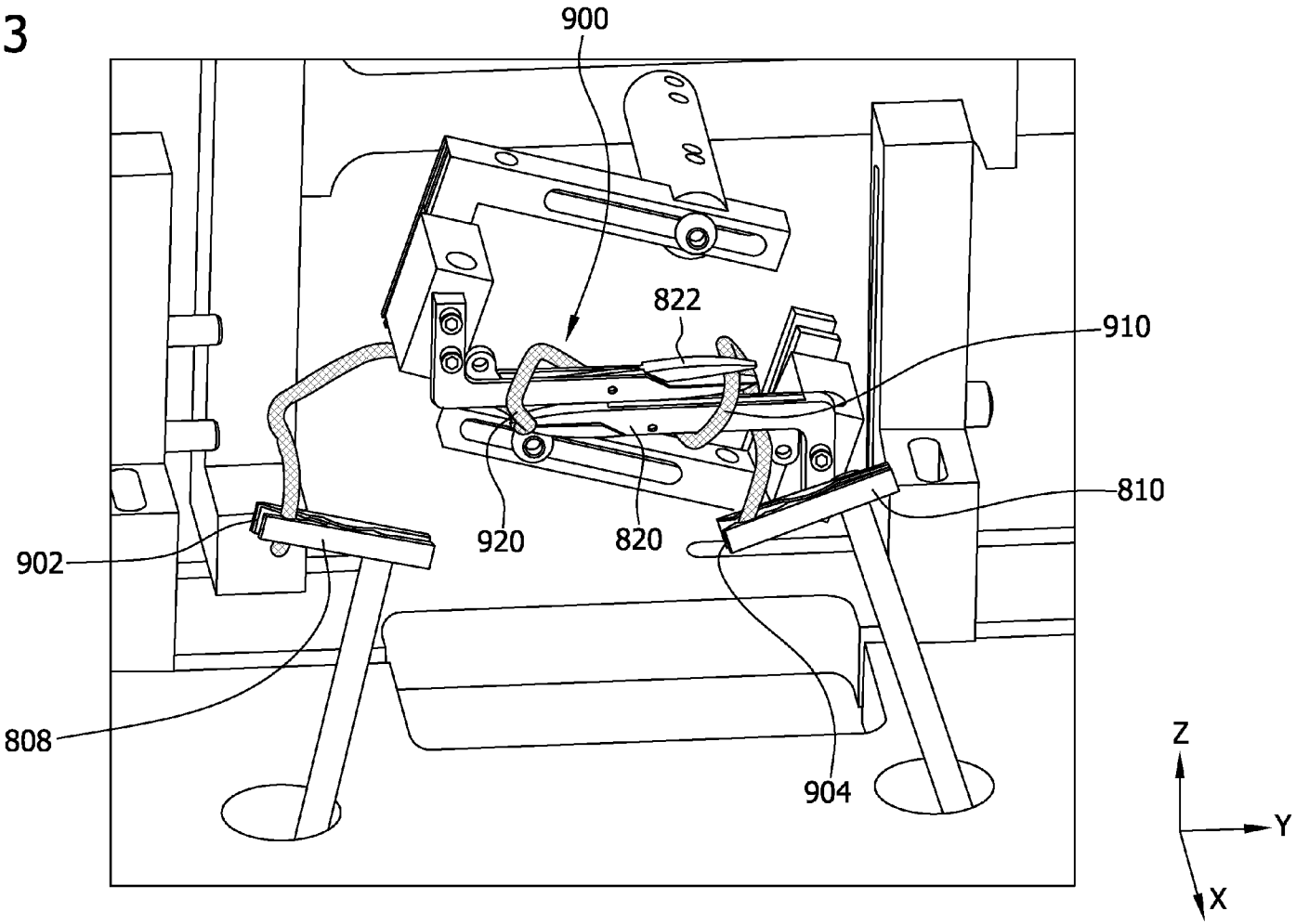
FIG. 13 is a perspective view of the system of FIG. 11 in a third position.

FIG. 13 shows the system 100 in a third position. In the third position, the jig halves 802, 804 have been moved laterally in the y-direction by the trolley assembly 510. In the exemplary embodiment, the jig halves 802, 804 are moved by the trolley assembly 510 to a position adjacent the cutting mechanism 400 to wrap another piece of ribbon around the jig halves. The jig halves 802, 804 are then moved by the trolley assembly 510 back to a position adjacent the forming mechanism 500 after the forming mechanism has tied the ribbon into a bow around the object 505.

Figure 14:
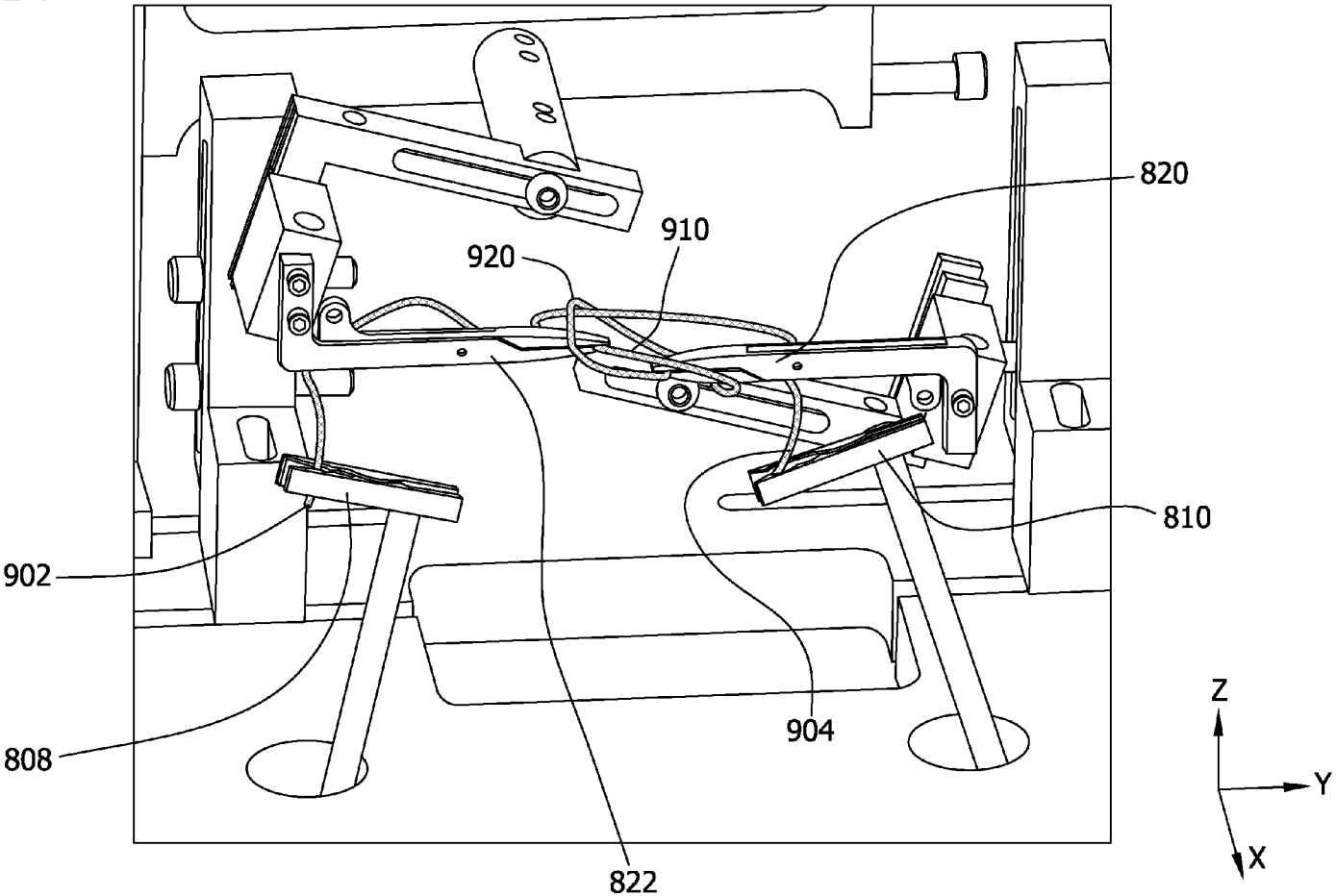
FIG. 14 is a perspective view of the system of FIG. 11 in a fourth position.

FIG. 14 shows the system 100 in a fourth position. In the fourth position, the first loop gripper 822 has moved laterally to the left in the direction of the y-axis, while the second loop gripper 820 has moved laterally to the right in the direction of the y-axis. The first loop gripper 822 is thus pulling the first loop 910 of the ribbon 900 through the second loop 920, while the second loop gripper 820 is pulling the second loop through the first loop.

Figure 15:
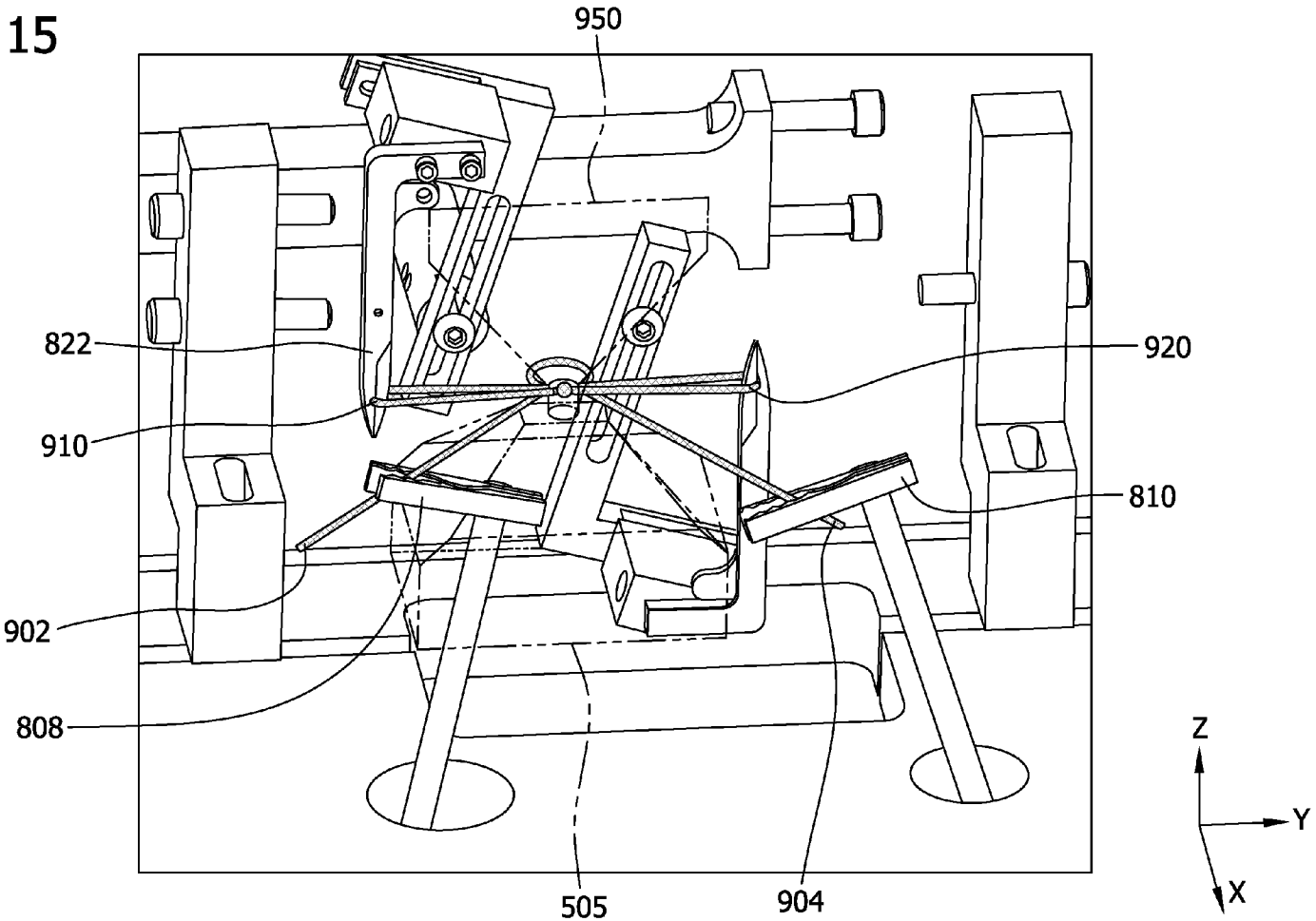
FIG. 15 is a perspective view of the system of FIG. 11 in a fifth position.

FIG. 15 shows the system 100 in a fifth position with the object 505 shown in phantom. In this position, the first loop gripper 822 has moved farther to the left and completely pulled the first loop 910 of the ribbon 900 through the second loop 920 of the ribbon. The second loop gripper 820 has likewise moved farther to the right and completely pulled the second loop 920 of the ribbon 900 through the first 910 of the ribbon. FIG. 15 thus shows the ribbon 900 tied in a completed bow around the object 505.

The first loop gripper 822 has also rotated approximately 90 degrees about an axis parallel to the x-axis such that the jaws are pointing downwards in FIG. 15. The second loop gripper 820 has also rotated approximately 90 degrees about an axis parallel to the x-axis such that the jaws are pointing downwards. The loop grippers 820, 822 rotate in this manner in the exemplary embodiment in order to rotate the loops 910, 920 of the ribbon 900. Rotation of the loops 910, 920 improves the appearance of the bow. In other embodiments, the loop grippers 820, 822 do not rotate in this manner.

After tying the ribbon 900 in the bow around the object 505, the tail grippers 808, 810 move to the open position and release the respective ends 902, 904 of the ribbon 900. The jaw assembly 592 of the object positioner 590 (FIG. 10) then releases the object 505 and the object falls into the discharge 610 where it is conveyed to a bin or other storage receptacle for further packaging and/or processing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system for tying material into a bow around an object, said system comprising:

a tying assembly for tying the material around the object into the bow, said tying assembly comprising:

a first loop gripper and a second loop gripper, said first loop gripper configured to grip a first portion of the material, said second loop gripper configured to grip a second portion of the material, said first loop gripper configured to pull the first portion of the material through the second portion of the material, said second loop gripper configured to pull the second portion of the material through the first portion of the material; and a first tail gripper and a second tail gripper, said first tail gripper configured to grip a first end of the material, said second tail gripper configured to grip a second end of the material; and a jig assembly for positioning the material relative to said tying assembly, said jig assembly moveable relative to the tying assembly, said jig assembly comprising:

a first jig half and a second jig half, said first jig half and said second jig half being rotatable about a longitudinal axis of said first jig half and said second jig half; and a trolley assembly for moving said first jig half and said second jig half with respect to said tying assembly.

2. The system of claim 1 further comprising a carousel for storing the material, the carousel configured for storing a plurality of different types of material.

3. The system of claim 2 further comprising a dispensing mechanism for dispensing material stored on said carousel.

4. The system of claim 3 further comprising a cutting mechanism for cutting material dispensed by said dispensing mechanism from said carousel.

5. The system of claim 4 wherein said cutting mechanism comprises a first cutting element, a second cutting element, and a third cutting element.

6. The system of claim 5 wherein said first cutting element is configured to cut the material along substantially the entirety of its width, such that the material is cut into discrete lengths that are of proper size to be tied around the object.

7. The system of claim 5 wherein said second cutting element is configured to cut a pair of notches in the material.

8. The system of claim 5 wherein said third cutting element is configured to cut an elongated notch in the material.

9. A system for tying material into a bow around an object, said system comprising:

a cutting mechanism for cutting material dispensed from a bulk source of the material;

a tying assembly for tying the material around the object into the bow, said tying assembly comprising:

a first loop gripper and a second loop gripper, said first loop gripper configured to grip a first portion of the material, said second loop gripper configured to grip a second portion of the material, said first loop gripper configured to pull the first portion of the material through the second portion of the material, said second loop gripper configured to pull the second portion of the material through the first portion of the material; and a first tail gripper and a second tail gripper, said first tail gripper configured to grip a first end of the material, said second tail gripper configured to grip a second end of the material; and a jig assembly for positioning the material relative to said tying assembly, said jig assembly moveable relative to the tying assembly, said jig assembly comprising:

a first jig half and a second jig half, said first jig half and said second jig half being rotatable about a longitudinal axis of said first jig half and said second jig half; and a trolley assembly for moving said first jig half and said second jig half with respect to said tying assembly.

10. The system of claim 9 wherein the bulk source of material comprises a carousel for storing the material, the carousel configured for storing a plurality of different types of material.

11. The system of claim 9 further comprising a dispensing mechanism for dispensing material stored on the bulk source.

12. The system of claim 9, wherein said cutting mechanism comprises at least one cutting element.

13. The system of claim 12 wherein said at least one cutting element is configured to cut the material along substantially the entirety of its width, such that the material is cut into discrete lengths that are of proper size to be tied around the object.

14. The system of claim 12, wherein said at least one cutting element is configured to cut a pair of notches in the material.

15. The system of claim 12, wherein said at least one cutting element is configured to cut an elongated notch in the material.

16. A method of tying material around an object into a bow using a system including an automated tying assembly having a first loop gripper and a second loop gripper, the method comprising:

gripping a first portion of the material with the first loop gripper;

gripping a second portion of the material with the second loop gripper;

automatically pulling, with the first loop gripper, the first portion of the material through the second portion of the material; and automatically pulling, with the second loop gripper, the second portion of the material through first portion of the material to tie the material around the object into a bow.

17. The method of claim 16 further comprising at least one of gripping a first end of the material with the first tail gripper and gripping a second end of the material with the second tail gripper.

18. The method of claim 16, the system further including a cutting mechanism and the method further comprising, prior to tying the material into the bow around the object, cutting the material into a predefined shape with the cutting mechanism.

19. The method of claim 18, the system further including a jig assembly and the method further comprising rotating the cut material with the jig assembly.

20. The method of claim 19, the system further including a trolley assembly, and the method further comprising moving the cut material to a position adjacent the automated tying assembly with the trolley assembly.

* * * * *